US005670731A

United States Patent [19]

Imaizumi

[11] Patent Number: 5,670,731

[45] Date of Patent: Sep. 23, 1997

[54] AUTOMATIC PERFORMANCE DEVICE CAPABLE OF MAKING CUSTOM PERFORMANCE DATA BY COMBINING PARTS OF PLURAL AUTOMATIC PERFORMANCE DATA

[75] Inventor: Tsutomu Imaizumi, Hamamatsu, Japan

[73] Assignee: Yamaha Corporation, Japan

[21] Appl. No.: 455,511

[22] Filed: May 31, 1995

[30] Foreign Application Priority Data

May 31, 1994 [JP] Japan ..... 6-118273

[51] Int. Cl.[6] ..... G10H 1/38

[52] U.S. Cl. ..... 84/613; 84/650; 84/DIG. 22

[58] Field of Search ..... 84/609–614, 634–638, 84/649–652, 666–669, DIG. 22

[56] References Cited

U.S. PATENT DOCUMENTS

| | | | |
|---|---|---|---|
| 4,656,911 | 4/1987 | Sakurai | 84/DIG. 12 |
| 5,200,566 | 4/1993 | Shimaya | 84/609 |
| 5,260,510 | 11/1993 | Shibukawa | 84/637 |
| 5,319,152 | 6/1994 | Konishi | 84/637 |
| 5,340,939 | 8/1994 | Kumagai | 84/609 |
| 5,347,082 | 9/1994 | Ojima | 84/609 |
| 5,350,880 | 9/1994 | Sato | 84/609 |
| 5,461,190 | 10/1995 | Terada | 84/609 |

*Primary Examiner*—Stanley J. Witkowski
*Attorney, Agent, or Firm*—Graham & James LLP

[57] ABSTRACT

Performance data memory may be a conventional automatic performance memory which store plural kinds of automatic performance data such as song data for achieving an automatic melody performance and pattern data for achieving an automatic accompaniment. Designation information is set optionally which designates at least part of desired automatic performance data. Further, a custom performance data memory is provided for storing the designation information in combination in desired order. The designation information is sequentially read out from the custom performance data memory, and at least part of the automatic performance data designated by the designation information is read out from the performance data memory. Thus, an automatic performance in which at least parts of plural sets of the automatic performance data are sequentially combined is provided as a custom performance. Chord is detected on the basis of performance data for each of plural sections of a music piece, and the song performance data is converted to relative data in accordance with the detected data. For a reproductive performance, a desired chord is designated, the relative song performance data is reconverted in accordance with the designated chord, and tone is reproductively generated on the basis of the reconverted performance data.

16 Claims, 8 Drawing Sheets

AUTOMATIC PERFORMANCE DEVICE CAPABLE OF MAKING CUSTOM PERFORMANCE DATA BY COMBINING PARTS OF PLURAL AUTOMATIC PERFORMANCE DATA

BACKGROUND OF THE INVENTION

The present invention relates an automatic performance device capable of making custom performance or accompaniment data of a music piece by combining parts of various performance data stored in a storage device.

Electronic musical instruments are in practical use today which store melody-contained automatic performance data of a music piece or accompaniment pattern data for generating accompaniment tones to player's actual performance operation and which are capable of automatically performing a music piece or automatic accompaniment by sequentially reading out the stored data. The accompaniment pattern data represents an accompaniment pattern for one or more measures and is read out in a repeated manner in accordance with the progression of a performance. In some of the known electronic musical instruments, separate accompaniment patterns are stored for each of plural rhythm styles such as march and waltz, but only one or only a few kinds of accompaniment patterns are stored for each of the rhythm styles.

Therefore, with the prior art electronic musical instruments of this type, the accompaniment pattern sounded in response to the player's designation of a rhythm style tends to be unavoidably fixed so that performance of the same accompaniment pattern is repeated, thus resulting in a monotonous accompaniment performance.

On the other hand, in order to perform an accompaniment by use of the automatic performance function, it is necessary for the user to enter and store all tones in advance, which is a very time consuming work. It also takes a considerable amount of time and labor to change the once-stored automatic performance data, and thus the performance data used has poor degree of freedom.

SUMMARY OF THE INVENTION

It is therefore an object of the present invention to provide an automatic performance device which is capable of making performance or accompaniment data having an increased degree of freedom in a simplified manner by optionally combining plural kinds of performance data such as automatic performance data and accompaniment pattern data.

In order to accomplish the above-mentioned object, an automatic performance device according to the present invention comprises a performance data storage section storing plural kinds of automatic performance data, a custom performance information storage section for storing designation information for designating at least part of desired automatic performance data, the custom performance information storage section storing a plurality of designation information in combination in desired order, a first readout section for sequentially reading out the designation information from the custom performance information storage section for a reproductive performance, and a second readout section for reading out at least part of the automatic performance data designated by the designation information read out from the first readout section, whereby an automatic performance is provided in sequential combination of at least parts of plural sets of the automatic performance data.

For example, in a preferred implementation, the performance data storage section includes a song data storage section storing song data of plural songs, and an accompaniment pattern data storage section storing accompaniment pattern data of plural accompaniment styles. The designation information for designating the song data includes information for designating a desired song and information for designating a desired performance section of the desired song. The designation information for designating the accompaniment pattern data includes information for designating a desired accompaniment style.

In the custom performance information storage section, there are stored custom performance data which contain, in order of the progression of a music piece, designation information for designating part of desired song data and accompaniment pattern data of a desired accompaniment style. The designation information designates part of the song data prestored in the song data storage section and one of the accompaniment style data prestored in the accompaniment pattern data storage section. In order to perform a custom accompaniment, the designation information is read out from the custom performance information storage section by the first readout section, and the song data or style data is read out by the second readout section on the basis of the designation information. Thus, creation of various accompaniment data can be achieved in a very simplified manner by freely combining the prestored song and style data, only requiring preparation of the designation information.

According to the present invention, the designation information may include repetition instructing information so that the designated song data or style data is read out repeatedly in accordance with the repetition instructing information. Further, there may be provided a repetition stop instructing section to compulsorily stop the repetition of the designated song or style data. This arrangement allows an accompaniment to be performed on the basis of desired designation information for any desired period, and facilitates the custom accompaniment pattern to a substantial degree.

Now, the preferred embodiment of the present invention will be described in detail below with reference to the accompanying drawings.

DETAILED DESCRIPTION OF THE PREFERRED EMBODIMENT

Figure 1:
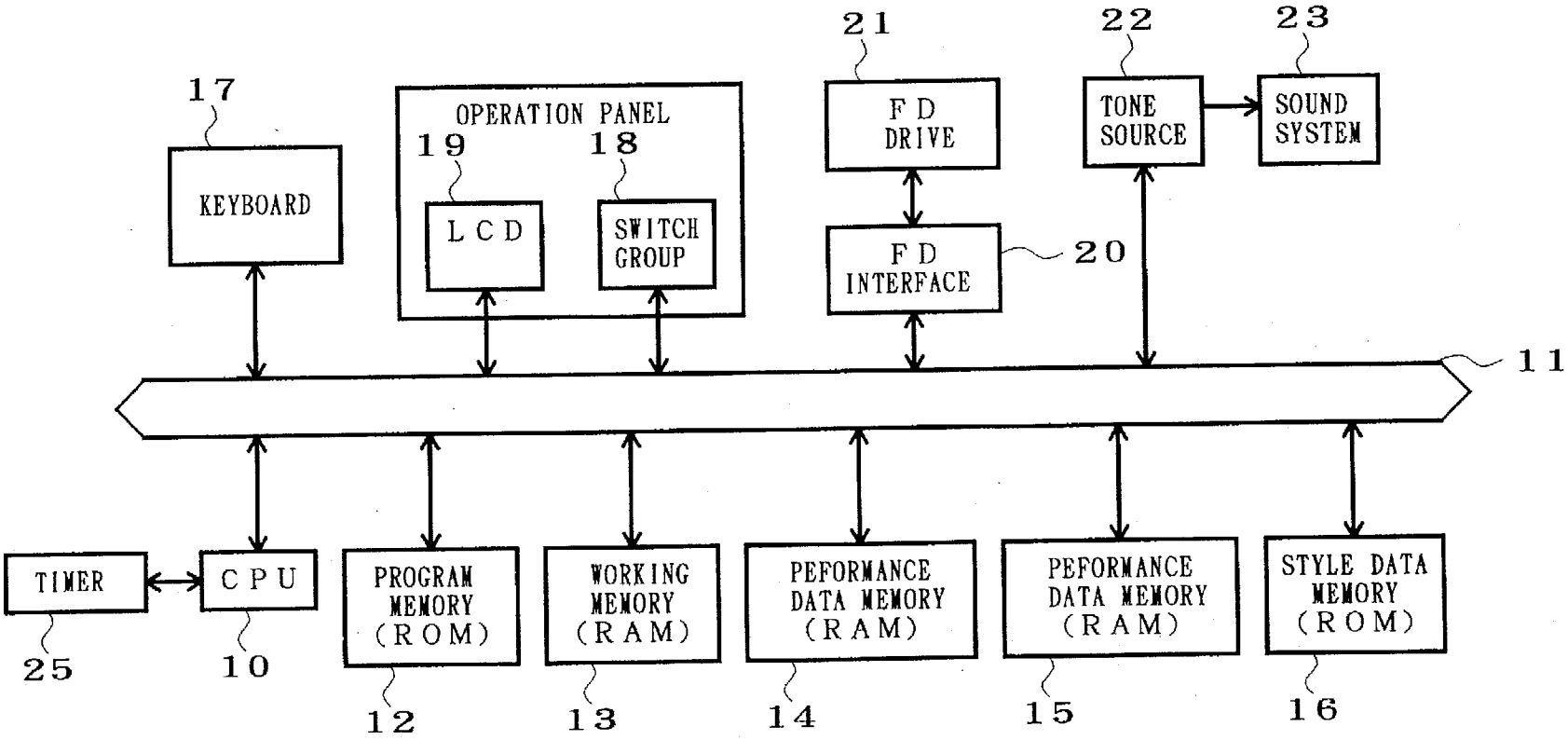
FIG. 1 is a block diagram illustrating an embodiment of an electronic musical instrument to which is applied an automatic accompaniment function of the present invention.

FIG. 1 is a block diagram illustrating an embodiment of an electronic musical instrument which is provided with an automatic performance function of the present invention. To a bus 11 are connected a CPU 10, a program memory 12, a working memory 13, song data memories 14 and 15, a style data memory 16, a keyboard 17, a switch group 18, an LCD (Liquid Crystal Display) 19, a floppy disk interface 20 and a tone source 22. A timer 25 is connected to the CPU 10 to count changing timing during an automatic performance. A floppy disk drive 21 is connected to the floppy disk interface 20, and song data (i.e., performance data forming a music piece) for one or more music pieces are prestored in a floppy disk set in the floppy disk drive 21. The keyboard 17 in this embodiment has keys over about five octaves and is capable of detecting key-on and key-off events and key depression velocity (key touch). The song data may be entered by the player via the keyboard 17, in addition to being read from the floppy disk. The switch group 18 includes key switches for selecting any of the song or pattern data and entering measure numbers of the selected data, a load switch, song data conversion switch, automatic accompaniment start/stop switch, music piece number selection switch, automatic performance start/stop switch, designation data enter switch group, custom accompaniment switch and NEXT switch as will be described later. A sound system 23 is connected to the tone source 22 to audibly reproduce or sound tone signal generated by the tone source 22. The sound system 23 is comprised of amplifiers and speakers.

Figure 2A:
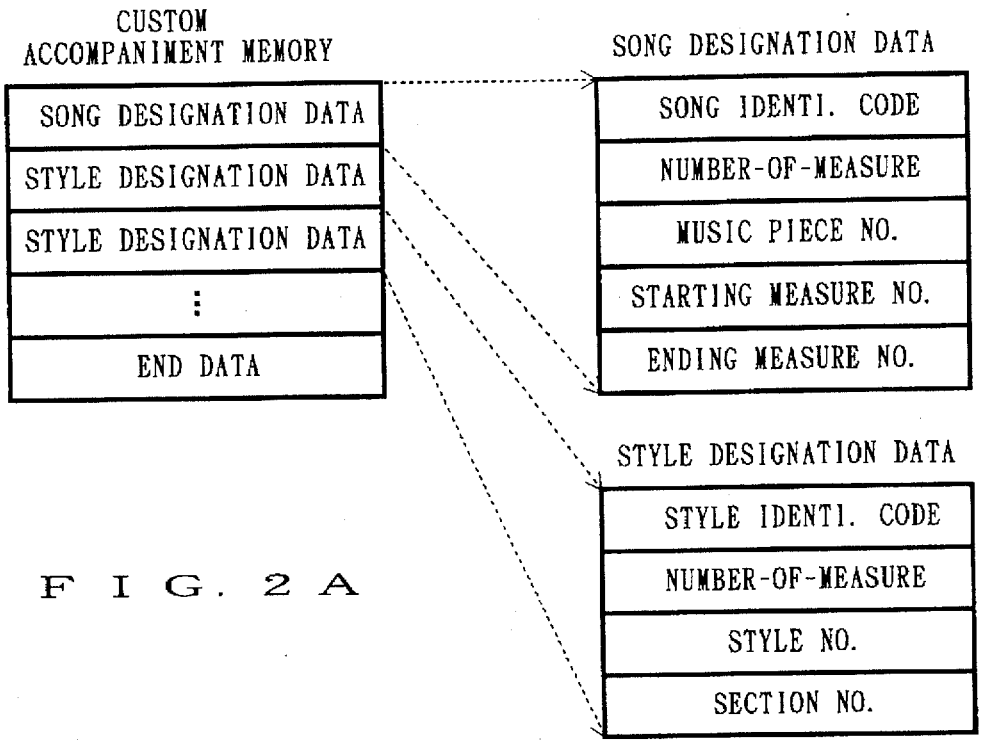
FIG. 2A is a diagram illustrating an example of stored contents in a custom accompaniment memory provided within a working memory of FIG. 1.
Figure 2B:
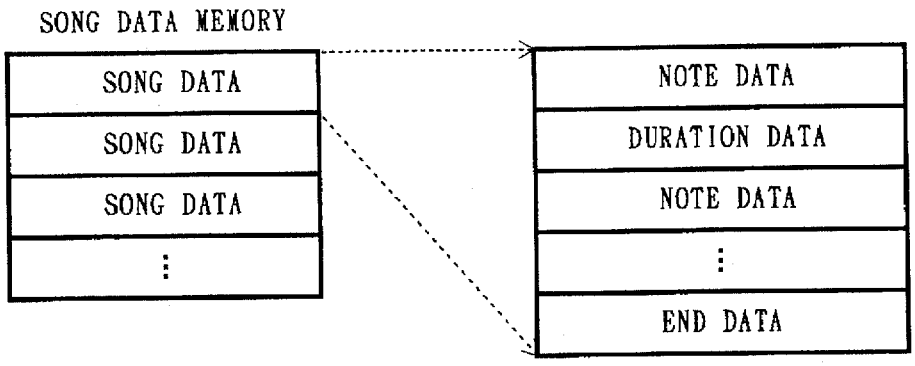
FIG. 2B is a diagram illustrating an example of stored contents in a song data memory provided within a performance data memory of FIG. 1.

The program memory 12 comprises a ROM, in which are stored operation control programs as shown in flowcharts to be later described. The working memory 13 comprises a RAM, in which are contained a custom accompaniment data memory as shown in FIG. 2A as well as registers for storing various data occurring during operation of the musical instrument. The first song data memory 14 comprises a RAM, which is arranged in a manner as shown in FIG. 2B. Song data read out from the floppy disk are stored directly in this memory 14. Each song data is a serial arrangement of note data and duration data indicative of time intervals between the note data and ends with end data. That is, the song data is a succession of note information representing a desired melody. The note data includes pitch data, velocity data, gate time data, etc, and here the gate time is indicative of a time length for which generation of a tone lasts. By adding up the values of all the duration data from the beginning of the music piece, the total number of measures can be calculated.

Figure 2C:
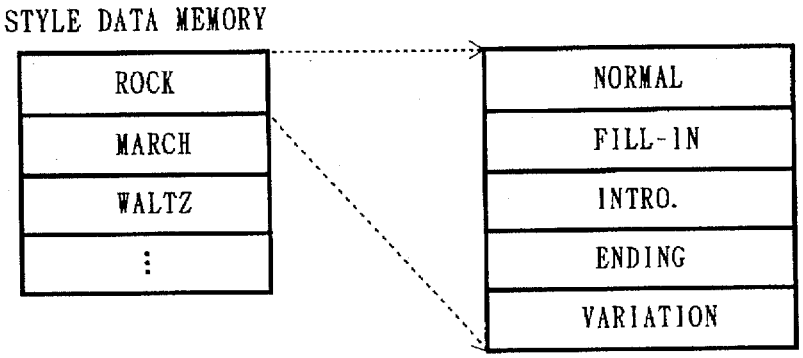
FIG. 2C is a diagram illustrating an example of stored contents in a style data memory of FIG. 1.

The second song data memory 15 also comprises a RAM, in which are stored relative song data indicative of relative values obtained from converting the pitch data, of the song data stored in the first song data memory 14, on the basis of a predetermined reference chord as will be later described in detail. The relative value conversion is performed by converting the pitch data for each phrase (ordinarily, for each measure) in such a manner that chords of every phrase of the song data each become C7 (C major seventh) chord. The resultant converted song data stored in the second song data memory 15 is read out during a custom accompaniment performance or normal song reproduction and are again pitch-converted to be adapted to a chord of a music piece being performed, so that the data is used as an accompaniment pattern. This song reproduction process will be later described in detail with reference to FIG. 9. Further, the style data memory 16 comprises a ROM, which is arranged in a manner as shown in FIG. 2C. In FIG. 2C, each style data is composed of pattern data for individual rhythm styles such as march and waltz, and the pattern data for each of the rhythm styles includes pattern data for individual sections such as normal pattern, fill-in pattern, intro-pattern, ending pattern and variation pattern. The pattern data for each of the sections is composed of plural note data and duration data arranged in order of performance, and an end data indicative of the end of the pattern.

In FIG. 2A, the custom accompaniment memory is employed for forming accompaniment data for one music piece by variously combining parts of the song data and the style data (pattern data). In the custom accompaniment memory, there are programmably stored a plurality of desired song designation data and style designation data in order of the progression of a music piece. The song designation data is such data that designates part of desired one of the plural song data stored in the song data memory, and is composed of a song identification code identifying that it is song designation data, performance measure data indicating the number of measures to be performed (reproduced) in correspondence to the designation data, music piece number data designating specific song data to be read out, and data indicative of desired starting and ending measure numbers of a section to be read out from the song data. The above-mentioned performance measure data may be set to indicate "1" or any other value greater than "1". If the thus-set number of performance measures is greater than the number of measures in a section defined by the starting and ending measures, the same section is read out in a repeated manner. The style designation data is composed of a style identification code identifying that it is style designation data, performance measure data indicating the number of measures to be performed for the style data, style number data designating a specific style to be read out, and section number data designating a desired section from among the style data. The above-mentioned performance measure data in the style designation data may be set to indicate "1" or any other value greater than "1". Desired song designation data and style designation data can be set and written into the custom accompaniment memory by operating any of designation data input switches contained in the switch group 18. Data read from the custom accompaniment memory is instructed by turning on the custom accompaniment switch.

Figure 3:
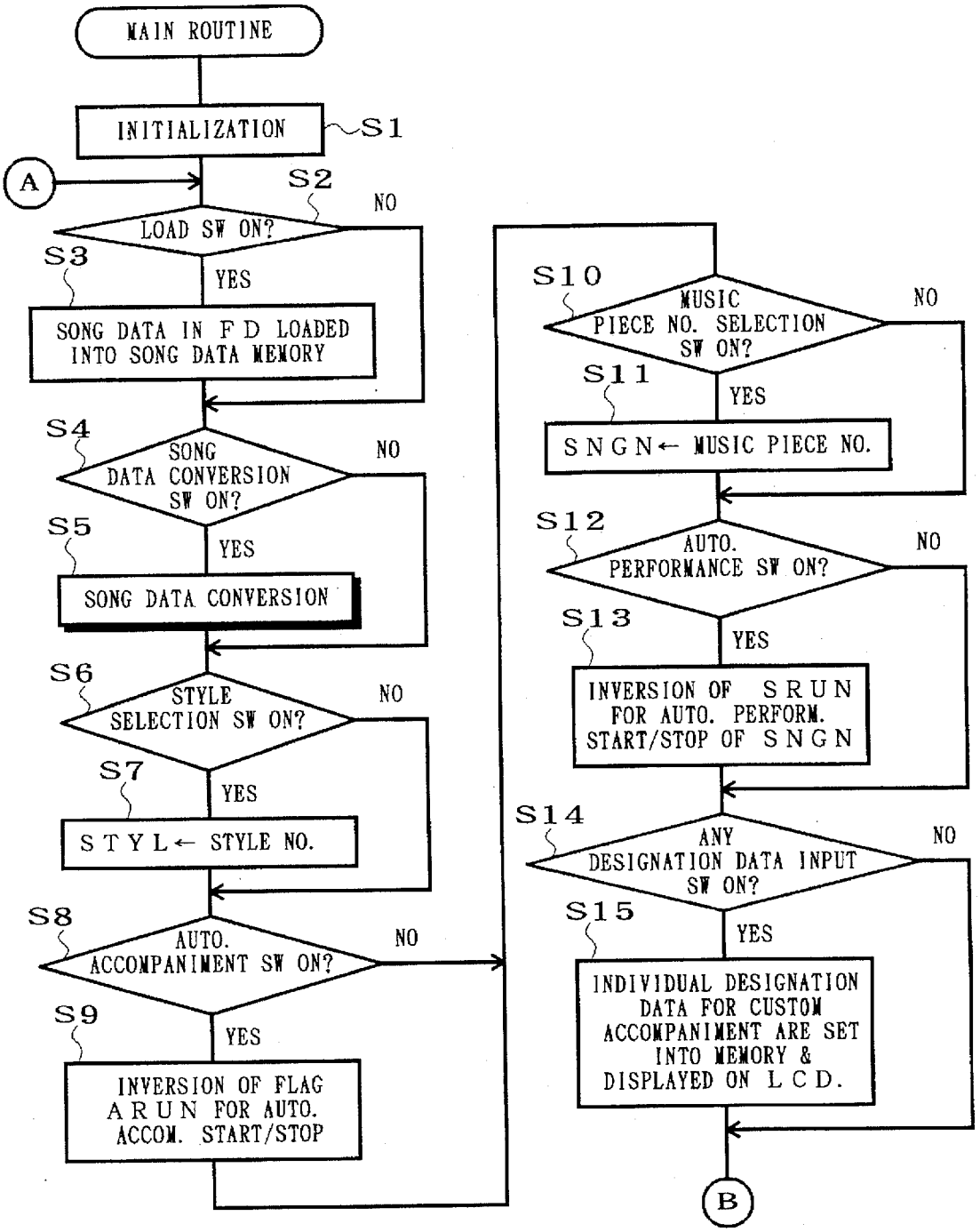
FIG. 3 is a flowchart illustrating a part of a main routine performed in the electronic musical instrument of FIG. 1.
Figure 4:
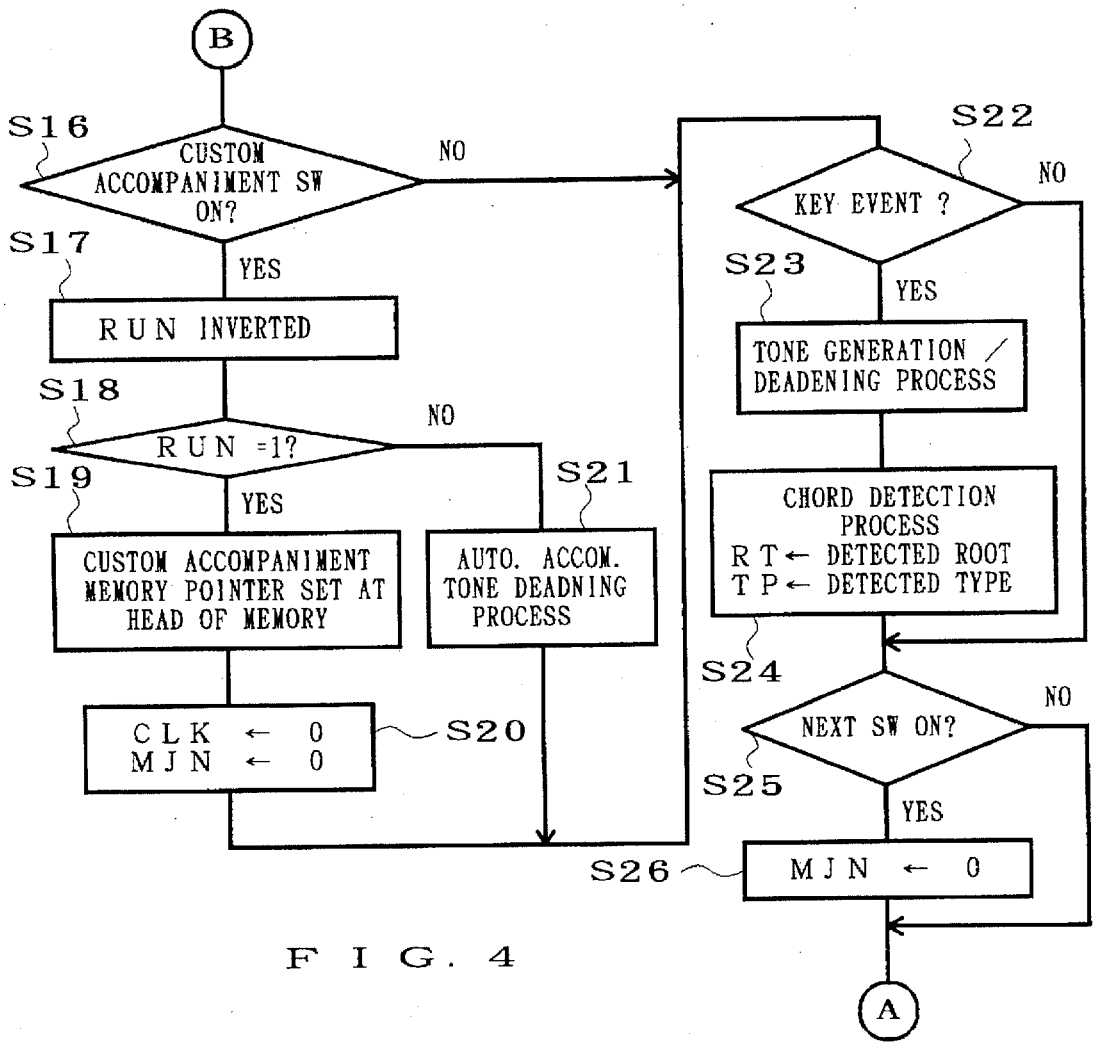
FIG. 4 is a flowchart illustrating the remaining part of the main routine.

FIGS. 3 to 8 are flowcharts illustrating various processes performed in the electronic musical instrument, of which FIGS. 3 and 4 show the main routine. Upon power-ON of the electronic musical instrument, the CPU 10 executes an initialization process (step S1). This initialization process places the musical instrument in operable condition, and then the musical instrument repeatedly performs the following main routine. In the main routine, sequential determination is made as to whether or not there is an on-event of the load switch (step S2), song conversion switch (step S4), style section switch (step S6), automatic accompaniment start/stop switch (step S8), music piece number selection switch (step S10), automatic performance start/stop switch (step S12), custom accompaniment input switch (step S14) and custom accompaniment switch (step S16), a key event (step S22), and an on-event of the NEXT switch (step S25).

Figure 5:
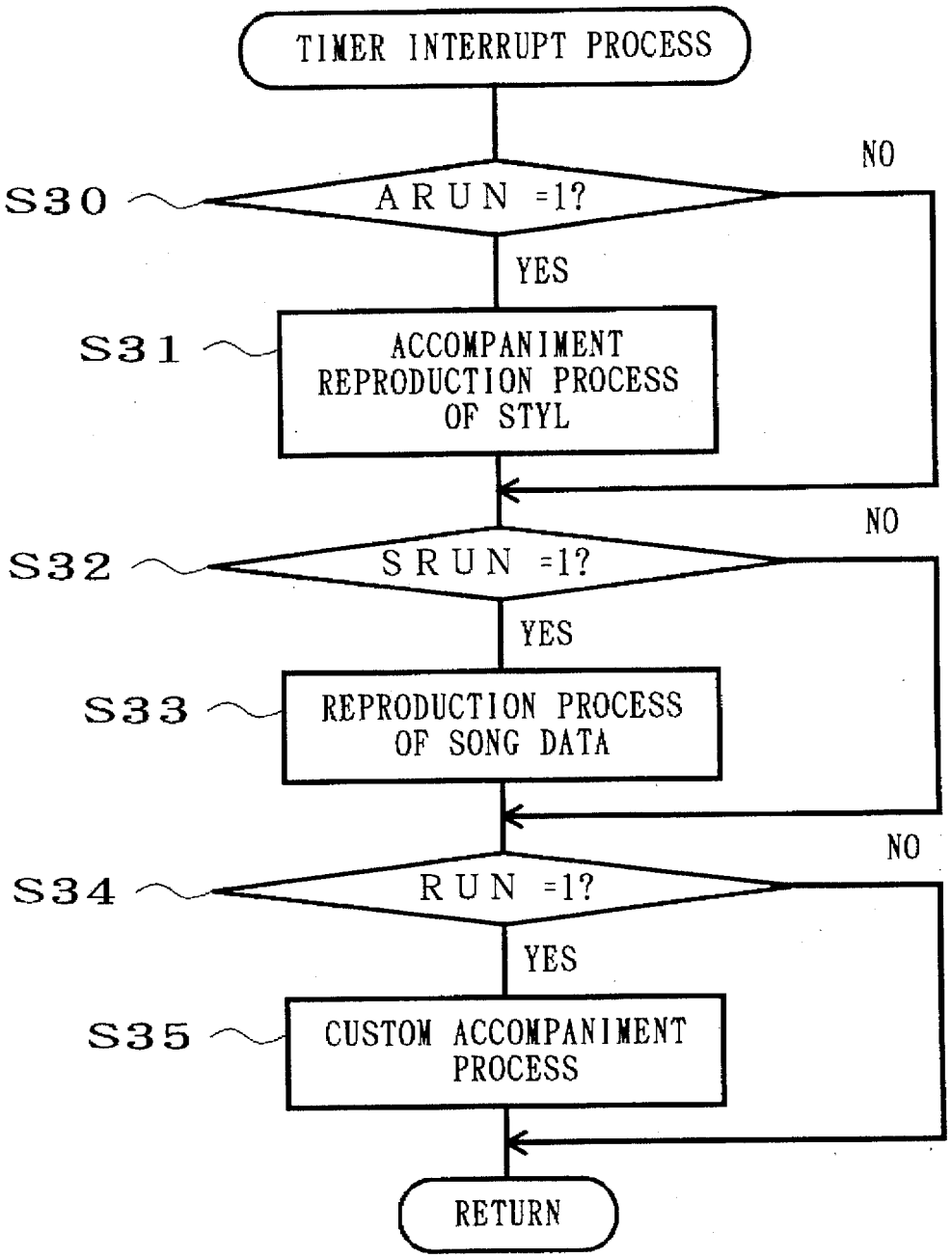
FIG. 5 is a flowchart illustrating an example of a timer interrupt process performed in the electronic musical instrument of FIG. 1.

Upon detection in step S2 of an on-event of the load switch, the routine goes to step S3, where song data stored in the floppy disk set in the floppy disk drive 21 are loaded into the first song data memory 14. The song data are stored as song data as shown in FIG. 2B. Upon detection in step S4 of an on-event of the song data conversion switch, the routine proceeds to step S5 to perform a song conversion process as will be later described with respect to FIGS. 6A and 6B. Upon detection in step S6 of an on-event of the style selection switch, the routine goes to step S7 so as to store a then-input style number into register STYL. Further, upon detection in step S8 of an on-event of the automatic accompaniment start/stop switch, the routine proceeds to step S9 to invert the value set in flag ARUN. If the resultant inverted value in the flag ARUN is "1", then reproduction of style data designated by the register STYL is executed in a timer interrupt process (FIG. 5). If the inverted value in the flag ARUN is "0", a style data reproduction having so far been performed is terminated. In this way, the inversion of the flag ARUN causes a start or stop of an automatic accompaniment. Upon detection in step S10 of an on-event of the music piece number selection switch, the routine proceeds to step S11 to store the selected music piece number into register SNGN. Further, upon detection in step S12 of an on-event of the automatic performance start/stop switch, the routine inverts the value set in flag SRUN. The inversion of the flag SRUN causes a start/stop of an automatic performance of the song data designated by the music piece number SNGN in the timer interrupt process.

Further, upon detection in step S14 of an on-event of any of the designation data input switches, the routine goes to step S15, where the individual designation data are set into the custom accompaniment memory of FIG. 2A in accordance with the operational state of the corresponding input switch. At the same time, the thus-set contents are shown on the LCD 19. In step S16 of FIG. 4, it is determined whether the custom accompaniment switch has been turned on: if answered in the affirmative, the routine proceeds to step S17 to invert the value set in flag RUN. If the resultant inverted value in flag RUN is "1", the routine proceeds to step S19 to set a custom accompaniment memory pointer at the head of the custom accompaniment memory (the uppermost location in FIG. 2A) and resets clock counter CLK and remaining-number-of-measure counter MJN to "0" (step S20), because a custom accompaniment will be executed by the timer interrupt process. If, on the other hand, the inverted value in the flag RUN is "0", this signifies an end of a custom accompaniment, and thus all accompaniment tones are deadened (step S21).

Upon detection in step S22 of a key event, the routine proceeds to step S23 to perform a tone generation or deadening process corresponding to the detected key event. Then, the routine proceeds to step S24, in which a chord is detected on the basis of a combination of tones being then generated, and the root and type (major, minor or dominant seventh chord) of the detected chord are stored in root register RT and type register TP, respectively. The root and type of the detected chord become a chord of accompaniment pattern in a custom or automatic accompaniment. If there has been detected an on-event of the NEXT switch in step S25, this instructs that song data or style data currently reproduced in a custom accompaniment mode should be terminated and changed to next song or style data, and the remaining-number-of-measure counter MJN is reset to "0". Thus, next designation data is read out in a custom accompaniment process contained in the timer interrupt process so as to reproduce next song/style data.

FIG. 5 is a flowchart of the timer interrupt process, which is performed at constant intervals (e.g., once for every 96th-note length). In steps S30, S32 and S34 of this process, determination is made as to whether the flags ARUN, SRUN and RUN are in the set or reset state. If any of the mentioned flags is in the set state, the corresponding accompaniment reproduction, song reproduction or custom accompaniment process is performed. Namely, if the flag ARUN is at "1", the accompaniment reproduction process is performed of a style designated by the flag STYL (step S31). If the flag SRUN is at "1", the song reproduction process is performed of a desired song designated by the register SNGN with reference to the second song data memory 15. Further, if the flag RUN is at "1", the custom accompaniment process is performed (step S35), as will be described in detail in connection with FIG. 7.

Figure 6A:
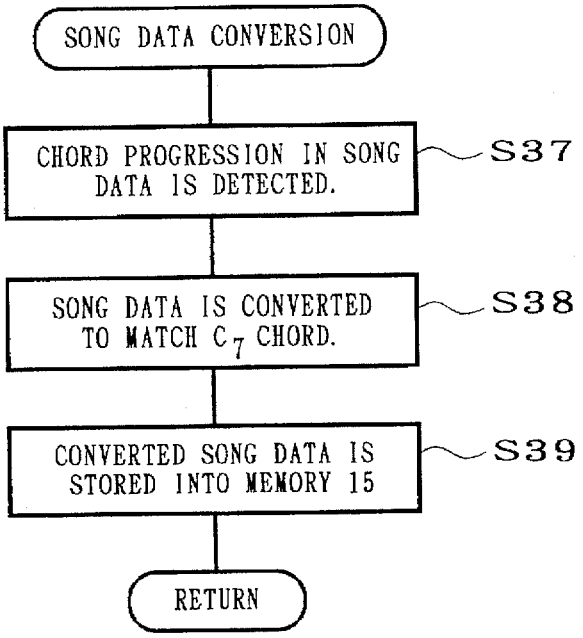
FIG. 6A is a flowchart illustrating an example of a song data conversion process of FIG. 3.

FIG. 6A is a flowchart of the above-mentioned song data conversion process. First, song data are sequentially read out from the song data memory 14, and a chord progression in the song data is detected for each of predetermined phrases (step S37). Then, the pitch data of the song data is converted to a relative value so that the chord of each phrase matches C7 chord (step S38). The thus-converted song data is stored into the song data memory 15 (step S39).

Figure 6B:
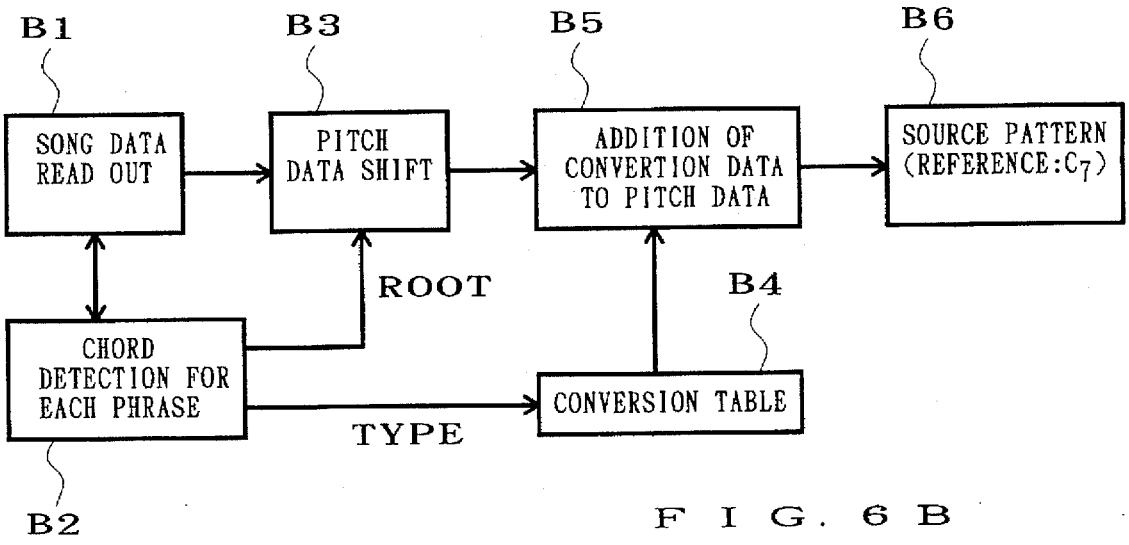
FIG. 6B is a functional block diagram explaining the song data conversion process of FIG. 6A in terms of data flow involved in the process.

FIG. 6B is a functional block diagram showing an example of the song data conversion process, in terms of data flow involved in the process, which is executed by the song data conversion process program of FIG. 6A. The song data conversion process will be described in greater detail with reference to FIG. 6B.

Block B1 corresponds to the operation of sequentially reading out song data from the first song data memory 14. The song data is a succession of note information corresponding to a desired melody as previously noted, and it may be assumed that the pitch data in the song data indicate absolute pitches in a given scale corresponding to the melody. Block B2 corresponds to the operation of detecting chord for each phrase on the basis of the song data sequentially read out in block B1. In this case, each phrase may be set to correspond to one measure or a half measure or correspond to any other appropriate section. In other words, it suffices to designate an optional section in melody progression (for example, one measure or a half measure) and detect chord on the basis of a group of notes of song data in the designated section. There are output respective data indicative of the root and type of the detected data.

In block B3, the pitch represented by each pitch data of the song data output in block B1 is shifted in accordance with the root of the chord of the corresponding section detected in block B2. Namely, each pitch data value is shifted by an amount corresponding to a difference between the detected root and a predetermined reference root (=pitch name C).

In block B4, an operation is performed to generate conversion data for, in accordance with the type of chord for each section detected in block B2, reading out a conversion table and replacing the pitch name of each chord component tone of the corresponding section by a predetermined reference type (i.e., seventh) chord. The conversion data presents a value "0" for a chord component tone at such a degree (interval from the root) requiring no conversion, but presents another value than "0" for a chord component tone at a degree requiring conversion. Namely, if the detected chord type is "major seventh", the conversion data presents "0" for the chord component tone at seventh degree that requires no conversion. But if the detected chord type is "major", the conversion data presents another value (e.g., "−1") for the chord component tone at seventh degree that requires conversion to be flatted by a semitone. The conversion table stores conversion data for tones at all degrees for each type.

In block B5, an operation is performed to receive the pitch data shifted in block B3 and add the conversion data output from block B4 to the pitch data. In this manner, the pitch data for each section (phrase) is converted, in accordance with the detected chord for the section (phrase), into relative pitch data based on the predetermined reference chord (C major seventh). In block B6, the song data thus converted into the relative data are stored into the second song data memory 15 as source pattern data to be used for an automatic performance. The reason why the song data are stored as automatic performance source pattern data for an automatic performance after having been converted to the relative data is to allow the song to be automatically reproduced at such pitches corresponding to a chord optionally designated by the player (namely, in a scale corresponding to the chord progression).

Figure 7:
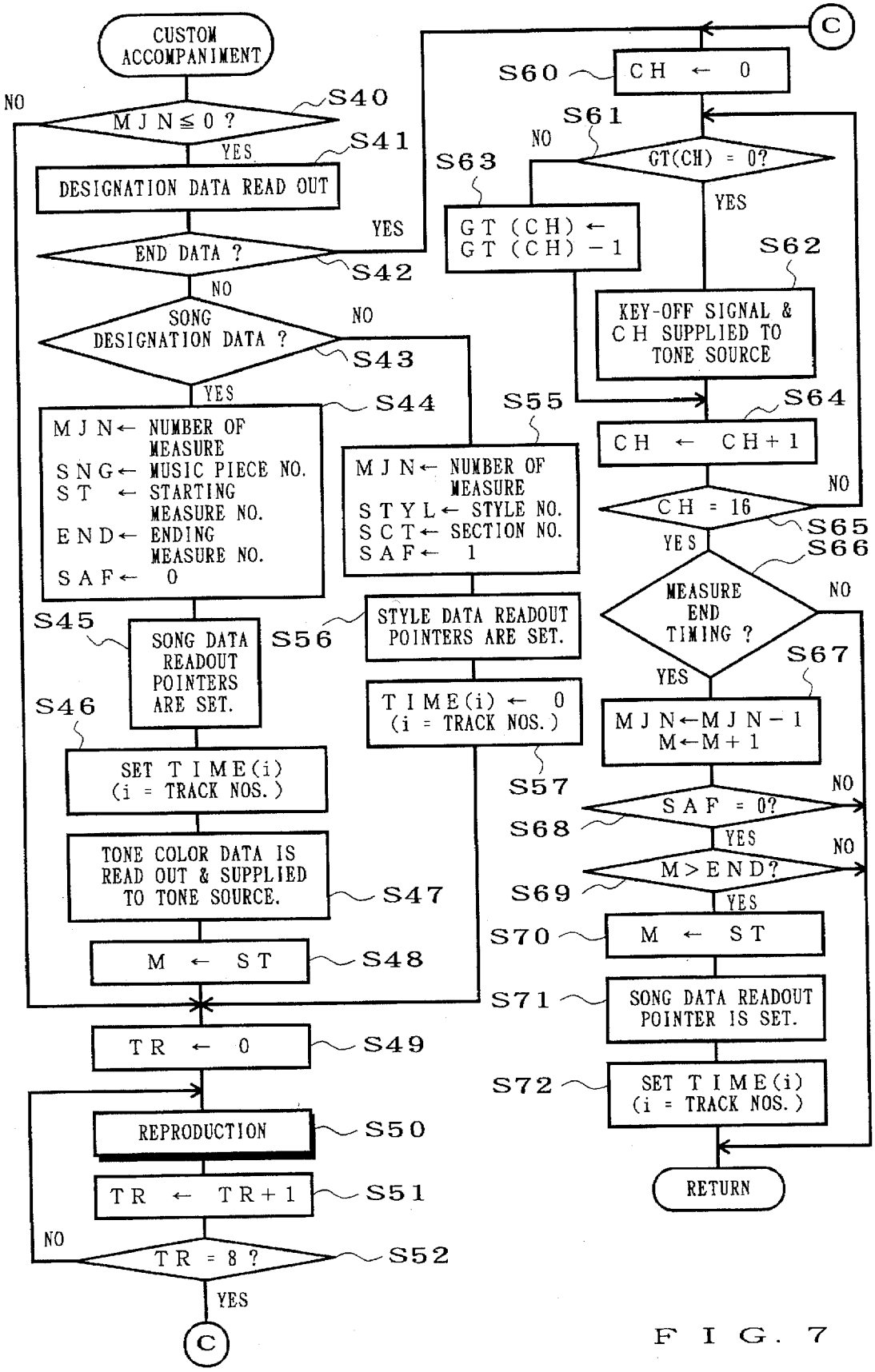
FIG. 7 is a flowchart illustrating an example of a custom accompaniment process of FIG. 5.

FIG. 7 is a flowchart of the custom accompaniment process, where it is first determined whether the remaining-number-of-measure counter MJN is at a count value equivalent to or smaller than "0" (step S40). The counter MJN is at "0" at the start of the operation since it has been reset in step S20 (see FIG. 4), and the program goes to step S41. In step S41, data pointed to by a custom accompaniment memory pointer is read out from the custom accompaniment memory, and then the pointer is moved to next data. In steps S42 and S43, it is determined what kind of data the read-out data is. If the read-out data is song designation data, operations in and after step 44 are performed. If the read-out data is style designation data, operations in and after step 44 are performed. If the read-out data is style end data, operations in and after step 60 are performed.

In step S44, data indicative of the number of performance measures, music piece number and starting and ending measure numbers contained in the song designation data are stored into the counter MJN and registers SNG, ST and END, respectively, and flag SAF is set at "0". This flag SAF is provided for indicating whether song data is being reproduced or style data is being reproduced. The flag SAF is set at "0" when song data is being reproduced. Then, the song data memory 15 is accessed on the basis of the music piece number SNG, starting measure number ST, etc., and respective song data readout pointers are set to point to the head data of the measure numbers ST of all tracks (step S45). Also, in step S46, time from the starting measure number ST up to first note data is set to timers of all tracks TIME (i) (i represents track numbers 0 to 7). Then, tone color data assigned to each track is read out from the song data memory and supplied to the tone source 22 (step S47). Preparation for the song data reproduction is completed by setting the starting measure ST into the measure number counter M (step S48).

Figure 8:
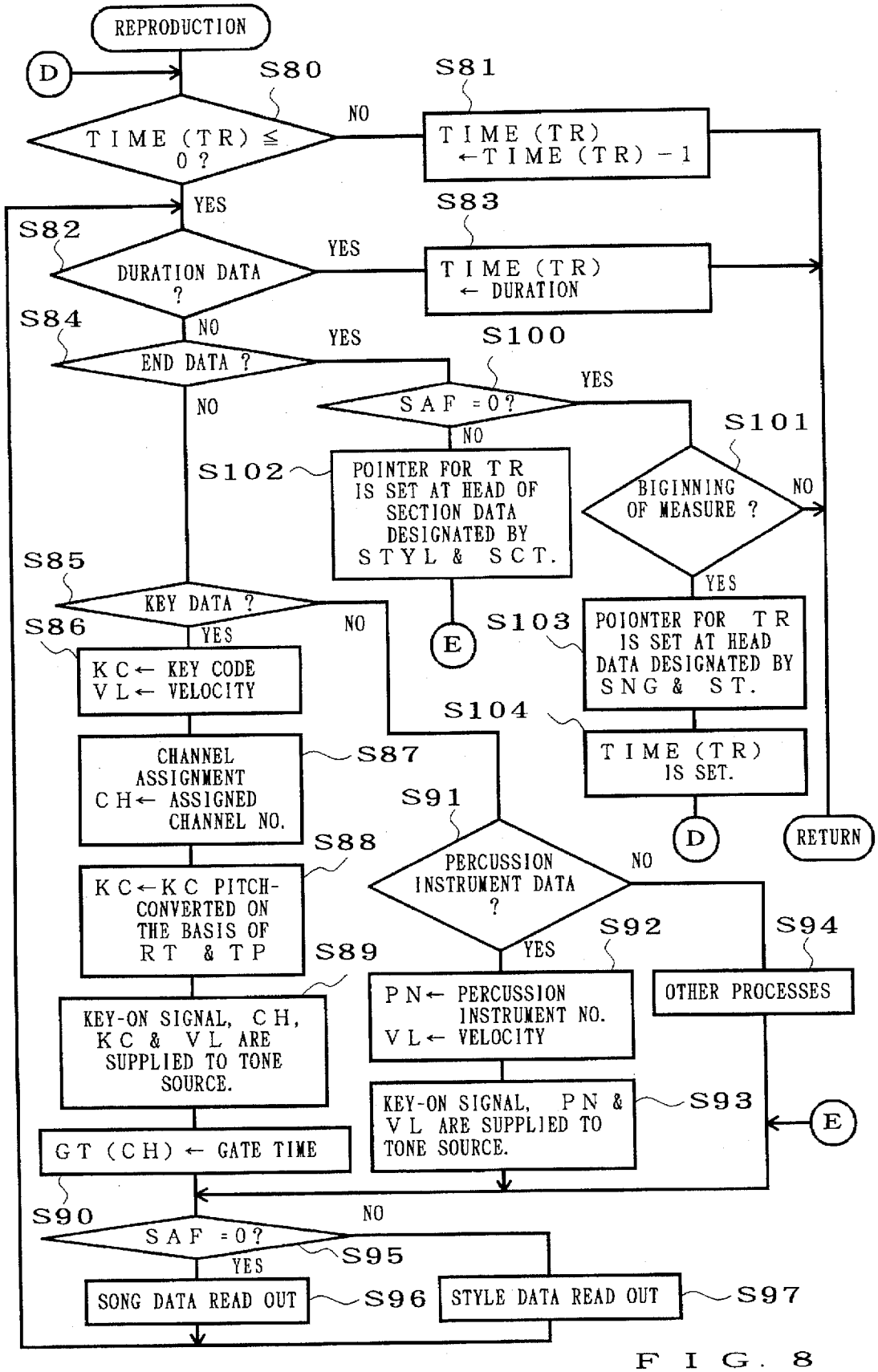
FIG. 8 is a flowchart of a reproduction process of FIG. 7.

In steps S49 to S52, reproduction process is performed for each track; namely, track pointer TR is set to "0" (step S49) and then reproduction is performed in step S50 repeatedly until the track pointer TR points to "7" in step S50, as will be detailed in correction with FIG. 8. In this way, reproduction for eight tracks TR 0 to 7 is performed. Once the track pointer TR has become "8" in step S52, the program goes to step S60.

If the read-out data is style designation data in step S41, the program proceeds to step S55 and following steps to perform operations similar to those performed in the case where the read-out data is song designation data. That is, in step S55, data indicative of the number of performance measures, style number and section number contained in the style designation data are stored into the counter MJN and registers STYL and SCT, respectively, and flag SAF is set at "1". The flag SAF at "1" indicates that song data is being reproduced. Then, the style data memory 16 is accessed on the basis of the style number STYL, section number SCT, etc., and respective style data readout pointers are set to point to the head data of the section data of all tracks (step S56). Also, in step S57, time up to first note data is set to timers for all the tracks TIME (i) (i represents track numbers 0 to 7). Thus, preparation for the style data reproduction is completed, and the program proceeds to step S49.

When the reproduction process has been completed or when end data has been read out from the custom accompaniment memory, the program goes to step S60. In steps S60 to S65, a gate time process and tone deadening process are performed for 16 tone generation channels. More specifically, first, in step S60, "0" is set into channel number register CM. Then, in step S61, a determination is made as to whether gate time GT(CH) is "0" (GT(CH)=0) or not. If the determination result in step S61 is "GT(CH)=0" signifying the end of tone generation, key-off signal and channel number CH are supplied to the tone source 22 to deaden the tone having been generated. If, on the other hand, the gate time GT(CH) is "1" or greater than "1", the gate time is decremented by one in step S63. These operations are performed sequentially for all the channels through steps S64 and S65.

It is further determined in step S66 whether the current timing is measure end timing. With a negative determination, the program returns to the main routine without performing any further operations. If, on the other hand, the current timing falls on measure end timing, the remaining-number-of-measure counter MJN is decremented by one and the measure number counter M is incremented by one (step S67). In next step S68, it is determined whether the flag SAO is at "0", i.e., song data is being reproduced. If answered in the negative in step S68, the program returns to the main routine. If the answer in step 68 is YES meaning that song data is being reproduced and if the measure number counter M is at a count value greater than ending measure number END in step S69, starting measure number ST is set into the counter M in step S70, the song data readout pointer is set at the head of the starting measure ST in the song data memory 15 in step S71 as in step S45 and time up to the first note data is set to the timer TIME(i) in step S72 as in step S46, so as to perform the song data in a repeated manner. In this way, performance of the same section of song data is repeated until the remaining-number-of-measure counter MJN reaches a count value of "0" or the player turns on the NEXT switch.

FIG. 8 is a flowchart of the reproduction process which is sequentially executed in the above-mentioned step S50 (see FIG. 7) for each of track numbers TR=0 to 7. It is determined in step S80 whether the value in the timer TIME(TR) for the track TR is "0" or smaller than "0". If the timer TIME(TR) is at a count value greater than "0", this means that the current timing has not yet arrived at tone generation timing, and thus the program returns to the main routine after decrementing the timer TIME(TR) by one (step S81). If TIME(TR)≦0, this means that the current timing is tone generation timing, data pointed to by the readout pointer for that track is read out from the song data memory 15 or style data memory 16. Then, the kind of the read-out data is determined in steps S82, S83, S84 and S91. If the read-out data is duration data as determined in step S82, the program proceeds to step S83 to set the duration time into the timer TIME(TR) and then returns to the main routine. If the read-out data is note data indicating that a scale note is to be generated as determined in step S85, the program goes to step S86 to set the key code of the note data into register KC and velocity data into register VL. After that, a tone generation channel is assigned for sounding of the key data, the number of the assigned tone generation channel is set into the register CH in step S89. Then, key-on signal, channel number CH, key code KC and velocity VL are supplied to the tone source 22 in step S89, on the basis of which the tone source 22 generates tone signal of the note data. The gate time of the note data is set into the register GT(CH) in step S90. Subsequently, next song data or style data is retrieved from the memory 15 or 16 in step S96 or S97 so as to read out note data to be concurrently sounded or duration data indicative of time up to next readout timing, then the program reverts to step S82. Which of song and style data should be read out is judged from whether the flag SAF is at "0" or "1" (step S95).

If the read-out data is percussion instrument data as determined in step S91, then the program proceeds to step S92 to store the percussion instrument number into register PN and the velocity data into the register VL. Then, key-on signal, percussion instrument number PN and velocity data VL are supplied to the tone source 22 (step S93), on the basis of which the tone source 22 generates tone signal. After that, the program proceeds to step S95. If the read-out data is end data as determined in step S84, it is determined whether SAF=0, i.e., whether it is the end of song data or style data. If SAF=1, this means that it is the end of repeated pattern data of several measures having an appropriate length, the pointer for the track TR is set at the head of section data designated by the registers STYLE and SCT in step S102 and reverts to step S95 to read out the head data. If, on the other hand, SAF=0, this signifies the end of song data, and thus it is further determined whether the current timing falls on the beginning of a measure in step S101. If the current timing falls on the beginning of a measure, because the song may be repeated with an appropriate pause, the pointer for the track TR is again set at the head data designated by the registers SNG and ST in step S103 and the timer TIME(TR) is set in step S104. If, however, the current timing is not the beginning of a measure as determined in step S101, repetition of the song data could break the rhythm, so that the program returns to the main routine without doing anything until the current timing is determined in step S101 as falling on the beginning of a measure.

According to the embodiment so far described, it is only necessary to prestore song and style designation data as custom accompaniment data, and custom accompaniment can be constructed by optionally combining partial sections of song data and style data. With such a feature, accompaniment in free, unrestricted form can be performed in a simplified manner.

Further, by increasing the value of the the number-of-measure data, it is also possible to repeatedly perform a partial section of the song data or the style data. When the counter MJN has reached a count of "0" or when the NEXT switch has been turned on, the repetition of performance is terminated so that the program moves onto next data, and accordingly, the player can change patterns on the basis of the player's real-time judgement. The repetition instructing information may be in any other form than described above. For example, performance duration or the number of times of repetition may be designated in stead of the number-of-measure data.

Figure 9:
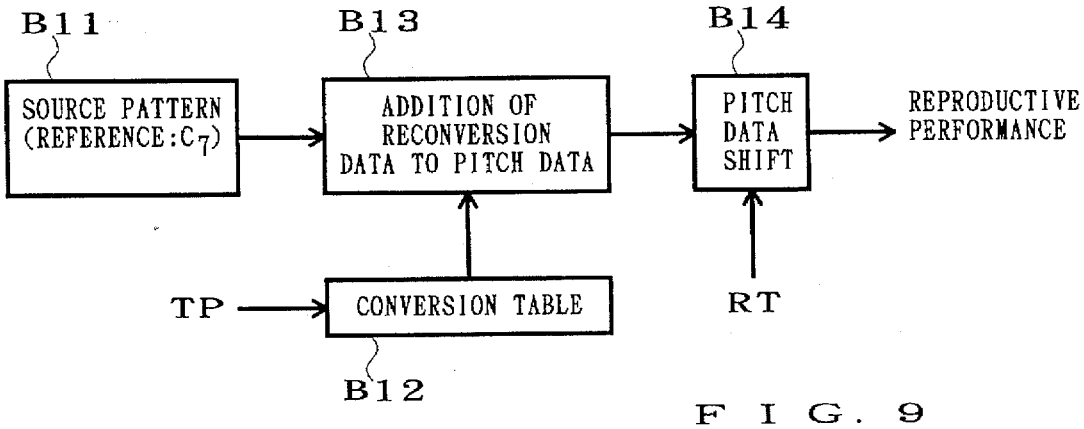
FIG. 9 is a functional block diagram explaining a song reproduction process in terms of data flow involved in the process.

FIG. 9 is a functional block diagram illustrating an example of the song reproduction process in terms of data flow involved in the process. This song reproduction process corresponds to the normal song reproduction performed in step S33 of FIG. 5, or to the partial reproduction of song data performed in the custom accompaniment shown in FIGS. 7 and 8. Block B11 corresponds to the operation to read out from the second data memory 15 song data comprised of relative data, i.e., source pattern data during the timer interrupt process of FIG. 5. Operation of supplying data indicative of the root RT and type TP of a designated chord corresponds to the operation of step S24 of FIG. 4. Namely, when the player designates or inputs desired chords, one after another, via the keyboard 17 as the performance progresses, each of the designated chords is detected in step S24 of FIG. 4 and data indicative of the root RT and type TP of each designated chord are obtained.

In Block B12, a conversion table, of a conversion characteristic opposite to that of the conversion table used in block B4 of FIG. 6B, is looked up in accordance with the type TP of the designated chord, so as to form reconversion data for reconverting the pitch name of each chord component tone from that corresponding to the predetermined reference chord type (seventh chord) to a value corresponding the designated chord type TP. The reconversion data presents "0" for a chord component tone at such a degree requiring no conversion, but presents another value than "0" for a chord component tone at a degree requiring conversion. Namely, if the detected chord type is "major seventh", the conversion data presents "0" for the chord component tone at seventh degree that need not be converted. But if the detected chord type is "major", the conversion data presents another value (e. g., "+1" ) for the chord component tone of seventh degree that needs conversion to be sharpened by a semitone. In the conversion table, there are stored reconversion data of tones at all degrees for chord type.

In block B13, an operation is performed to input the pitch data of the song data read out in block B11 and add the reconversion data output from block B12 to the input pitch data. Further, in block B14, in accordance with the root RT of the designated chord, an operation is performed to shift the pitch, indicated by relative pitch data output from block B13, in the direction opposite to that in block B3 of FIG. 6B. Namely, because the relative pitch data output from block B13 is based on the predetermined root (=pitch name C), block B14 shifts the pitch data to a pitch based on the designated root RT. In this way, in response to designation of a desired chord, each song is reproductively sounded during the automatic reproduction at pitches matching the designated chord (i.e., at a scale corresponding to the designated chord progression).

The song data to be treated in the song data conversion process shown in FIGS. 6A and 6B may be performance data responsive to the real-time performance operation via the keyboard or the like, other than those read out from the memory as mentioned above in connection with the embodiment.

Further, although in the above-described embodiment, the source pattern for reproduction is supplied by temporarily storing in the memory 15 song data converted through the song data conversion process of FIGS. 6A and 6B and then reading out the thus-converted song data from the memory 15, such a source pattern may be supplied without being temporarily stored in the memory 15.

According to the present invention as has so far been described, it is only necessary to prestore data designation data in the custom accompaniment data memory in order of the progression of a music piece, and automatic accompaniment is performed by reading out song and style data on the basis of the designation data style data. With this feature, it is allowed to perform unmonotonous accompaniment of high degree of freedom on the basis of simple setting. Further, the custom accompaniment data can be simplified to a substantial degree by including repetition instructing data in the designation data and providing repetition stop instructing means for terminating repetition based on the repetition instructing data.

What is claimed is:

1. An automatic performance device comprising:

performance data storage means for storing a plurality of different kinds of automatic performance data;

custom performance information storage means for storing designation information for designating a plurality of selected portions of said automatic performance data, said custom performance information storage means storing a plurality of said designation information in combination in a desired order;

first readout means for sequentially reading out the designation information from said custom performance information storage means for a reproductive performance; and second readout means for reading out said plurality of selected portions of the automatic performance data designated by the designation information read out from said first readout means, whereby an automatic performance of said plurality of selected portions of the automatic performance data is provided in sequential combination.

2. An automatic performance device as defined in claim 1, wherein said performance data storage means includes song data storage means for storing song data of a plurality of songs and accompaniment pattern data storage means for storing accompaniment pattern data of a plurality of accompaniment styles, wherein said designation information includes designation information for designating the song data and designation information for designating the accompaniment pattern data, wherein the designation information for designating the song data includes information for designating a desired song and information for designating a desired performance section of the desired song, and wherein said designation information for designating the accompaniment pattern data includes information for designating a desired accompaniment style.

3. An automatic performance device as defined in claim 1, which further comprises programming means for programming a desired custom performance pattern by optionally setting plural said designation information to be stored in said custom performance information storage means.

4. An automatic performance device as defined in claim 1, wherein said designation information includes repetition instructing information for instructing that a selected portion of the automatic performance data should be reproduced repeatedly, and wherein when the repetition instructing information is present in the designation information read out by said first readout means, said second readout means repeatedly reads out from said performance storage means said selected portion of the automatic performance data designated by the designation information.

5. An automatic performance device as defined in claim 4, wherein the repetition instructing information includes information for designating a specific number of measures to be performed.

6. An automatic performance device as defined in claim 4, wherein the repetition instructing information includes position information for designating a reproduction-start position and a reproduction-end position in the desired automatic performance data designated by the designation information and includes length information for designating a length of the reproductive performance, and wherein said second readout means repeatedly reads out the desired automatic performance data from the reproduction-start position to the reproduction-end position designated by the position information for a period corresponding to the length of the reproductive performance designated by the length information.

7. An automatic performance device as defined in claim 6, wherein the length information includes measure information for designating the total number of measures to be performed, and wherein said second readout means repeatedly reads out the automatic performance data from the reproduction-start position to the reproduction-end position designated by the position information for a period corresponding to the total number of measures designated by the measure information.

8. An automatic performance device as defined in claim 4, which further comprises repetition stop instructing means for giving an instruction to stop repeated reproduction by said second readout means.

9. An automatic performance device as defined in claim 1, wherein said designation information includes information to designate a desired starting measure and a desired ending measure and information designating a specific number of measures, in order to designate a desired part of the desired automatic performance data, and wherein said second readout means reads out the automatic performance data from the designated starting measure to the designated ending measure, and when a number of measures from the designated starting measure to the designated ending measure is smaller than the designated specific number of measures, said second readout means repeats readout of said automatic performance data from the designated starting measure to the designated ending measure until said designated specific number of measures is reached.

10. An automatic performance device comprising:

performance data supply means for supplying performance data including a succession of note information representative of a music piece;

chord detection means for, on the basis of the performance data supplied from said performance data supply means, detecting a chord for each of plural sections of the music piece;

conversion means for converting the performance data supplied from said performance data supply means for each said section, in accordance with the chord detected by said chord detection means for said section; and storage means for storing the performance data converted by said conversion means, wherein said conversion means converts the note information in the performance data into a relative value in accordance with a difference between a predetermined reference chord and the detected chord, said relative value representing specific note information based on said predetermined reference chord.

11. An automatic performance device as defined in claim 10 wherein said performance data supply means includes a memory storing the performance data and means for reading out the performance data from said memory.

12. An automatic performance device as defined in claim 10, wherein said performance data supply means includes means for supplying the performance data in real-time in response to a performance operation.

13. An automatic performance device as defined in claim 10 which further comprises:

means for reading out the converted performance data from said storage means for a reproductive performance;

chord designating means for designating a chord during the reproductive performance; and tone reproduction means for reconverting the read-out performance data in accordance with the chord designated by said chord designating means and for generating a tone on the basis of the reconverted performance data.

14. An automatic performance device comprising:

performance data supply means for supplying performance data including a succession of note information representative of a music piece;

chord detection means for, on the basis of the performance data supplied from said performance data supply means, detecting a chord for each of a plurality of sections of the music piece;

chord designating means for designating a chord for a reproductive performance;

conversion means for converting the performance data supplied from said performance data supply means for each said plurality of sections in accordance with a correlation between the chord detected by said chord detection means for said section and the chord designated by said chord designating means; and tone reproduction means for generating a tone on the basis of the performance data converted by said conversion means.

15. An automatic performance device comprising:

performance data supply means for supplying performance data including a succession of note information representative of a music piece;

chord detection means for, on the basis of the performance data supplied from said performance data supply means, detecting a chord for each of a plurality of sections of the music piece;

conversion means for converting the performance data supplied from said performance data supply means for each of said plurality of sections in accordance with the chord detected by said chord detection means, wherein said conversion means converts the note information in the performance data into a relative value in accordance with a difference between a predetermined reference chord and the detected chord;

first storage means for reserving the automatic performance data before conversion by said conversion means; and second storage means for storing the performance data converted by said conversion means.

16. An automatic performance device comprising:

performance data storage means storing plural kinds of automatic performance data;

custom performance information storage means for storing designation information for designating part of desired said automatic performance data, said custom performance information storage means storing a plurality of said designation information in combination in desired order;

first readout means for sequentially reading out the designation information from said custom performance information storage means for reproductive performance;

second readout means for reading out selected automatic performance data designated by the designation information readout from said first readout means, whereby selected automatic performance data is provided in sequential combination;

chord detection means for detecting a chord on the basis of the automatic performance data supplied from said second readout means;

chord designating means for designating a chord for a reproductive performance;

conversion means for converting the automatic performance data supplied from said second readout means, in accordance with a correlation between the chord detected by said chord detection means and the chord designated by said chord designating means; and tone reproduction means for generating tone on the basis of the automatic performance data converted by said conversion means.

* * * * *